US009413060B2

(12) United States Patent
Wong et al.

(10) Patent No.: US 9,413,060 B2
(45) Date of Patent: Aug. 9, 2016

(54) STICK-ON MULTI-FREQUENCY WI-FI BACKPACK AND HELMET ANTENNA

(71) Applicants: Gary Gwoon Wong, Torrance, CA (US); Calvin Gwoon Wong, Torrance, CA (US); Perry Gwoon Wong, Torrance, CA (US); Kalem Gwoon Wong, Torrance, CA (US)

(72) Inventors: Gary Gwoon Wong, Torrance, CA (US); Calvin Gwoon Wong, Torrance, CA (US); Perry Gwoon Wong, Torrance, CA (US); Kalem Gwoon Wong, Torrance, CA (US)

( * ) Notice: Subject to any disclaimer, the term of this patent is extended or adjusted under 35 U.S.C. 154(b) by 195 days.

(21) Appl. No.: 14/284,393

(22) Filed: May 22, 2014

(65) Prior Publication Data

US 2015/0340758 A1 Nov. 26, 2015

(51) Int. Cl.

*H01Q 1/27* (2006.01)
*H01Q 9/28* (2006.01)
*H01Q 1/38* (2006.01)

(52) U.S. Cl.

CPC ..... *H01Q 1/276* (2013.01); *H01Q 1/273* (2013.01); *H01Q 1/38* (2013.01); *H01Q 9/285* (2013.01)

(58) Field of Classification Search

CPC ..... H01Q 1/276; H01Q 1/38; H01Q 1/273; H01Q 9/285; H01Q 7/00; H01Q 13/10; G04G 21/04

See application file for complete search history.

(56) References Cited

U.S. PATENT DOCUMENTS 6,259,399 B1 * 7/2001 Krasner ..... G01S 5/0027 342/196
6,809,692 B2 * 10/2004 Puente Baliarda ... H01Q 1/1271 343/711
7,002,526 B1 * 2/2006 Adams ..... H01Q 1/273 343/718
8,773,322 B2 * 7/2014 Wong ..... H01Q 9/285 343/795
2005/0116873 A1 * 6/2005 Soler Castany ..... H01Q 1/38 343/795
2006/0022882 A1 * 2/2006 Gerder ..... H01Q 1/273 343/718
2008/0117112 A1 * 5/2008 Inbal ..... H01Q 1/1207 343/718
2012/0081260 A1 * 4/2012 Wong ..... H01Q 19/106 343/807
2014/0226645 A1 * 8/2014 Tween ..... H04W 84/005 370/338
2014/0232606 A1 * 8/2014 Niver ..... H01Q 21/26 343/797
2015/0311592 A1 * 10/2015 Wong ..... H01Q 21/0075 343/813

FOREIGN PATENT DOCUMENTS

GB WO 2012001367 A1 * 1/2012 ..... H01P 3/081

* cited by examiner

*Primary Examiner* — Michael Zarroli

(57) ABSTRACT

A high performance broadband antenna for backpack and helmet application allowing data, video, and voice transmission between parties. The antenna consists of a pair of triangle shaped elements which are configured to stick on a backpack surface or place over a helmet with a coaxial cable connecting a radiating structure to the communication equipment on the body. A metal shielding performs as a ground plane and also acts as a protectant from radiation hazards to the head or body areas. The antenna is made with materials that conform to the shape of a helmet or stick directly onto a backpack surface. This design can function under multiple frequencies on UHF and S bands; its placement on a helmet receives less Interference from Its surroundings.

1 Claim, 2 Drawing Sheets

STICK-ON MULTI-FREQUENCY WI-FI BACKPACK AND HELMET ANTENNA

FIELD

Figure 1:
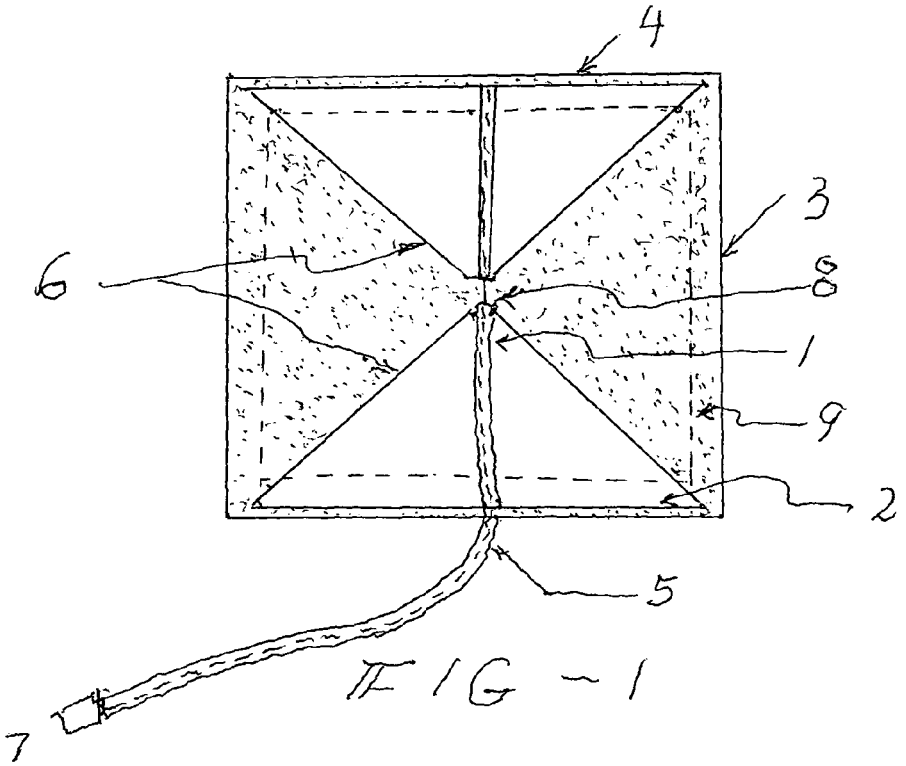

This disclosure provides new art in design and fabrication of antenna structures that are configured to stick onto a top of a helmet or onto a backpack outer surface in performing Wi-Fi communication.

The radiating elements of the helmet and backpack stick-on antenna structures are configured after the patent application Ser. No. 13/200,521 antenna structure in which the triangular radiating elements are excited by a coaxial cable over the top of the radiating structures.

SUMMARY OF THE INVENTION

A new design and implementation of a high performance broadband antenna configured for Wi-Fi application is disclosed. The antenna is designed for communication systems allowing data, video, and voice transmission between parties. The invention antenna consists of a pair of triangle shape elements which are made to fit over a helmet or simply stick onto a backpack. The triangular elements are positioned in such a way that their vertex angles are pointing at one another and are excited by a coaxial cable which runs along the center. The outer shield of the coaxial cable is electrically connected to one side of the radiating element and the center conductor is connected to the opposing side of the radiator. A gap approximately ⅜ inches is maintained. The connection in this manner forms a unique infinite balun (balanced-to-unbalanced converter) in obtaining a good impedance response over a wide frequency band. Special attention has been given to the design to ensure that harmful radiation will not be occurred. Thus a metal shield is implemented. The function of the shield is to direct harmful radiation away from the head and body area. The shield is also function as a ground plane for the radiating element. The separation distance between the radiating element and its ground plane is about 0.1 wavelengths. A prototype model has been made and tested; the electrical performance of this disclosure has performed as stated.

The preferred embodiment additionally comprises a pair of broad band triangle shape elements which are symmetrically excited by a coaxial cable in a unique way and additional matching device is not required.

The preferred embodiment structure is extremely broad band because of the element design along with its excitation. For high frequencies, the radiator is resonated near the apex, and for low frequencies the radiator is resonated near the far end of the triangle element.

The preferred embodiment structure vertex angle is 90 degrees and the base angles of the radiating element are 45 degrees for stick-on helmet antenna and also a 90 degrees vertices angle and 45 degrees base angle for stick-on backpack radiating element. A small change of angles may be employed which will not alter the physical and impedance characteristics of the antenna appreciably. The antenna design is not sensitive to dimensional tolerance.

The preferred embodiment radiating element consist a pair of unique triangle shape metal surfaces that are positioned over a metal conducting ground plane to be stick onto the helmet or stick onto the backpack surface directly.

The preferred embodiment backpack stick-on antenna is protected by a cover and the cover surface can be decorated with colorful words or figures of personal preference.

The coaxial cable of the preferred embodiment is terminated with a mating connector which is connecting to the electronic equipment.

The preferred embodiment structure is made with materials that is easily conform and fit over a helmet as well as to the backpack. A stick-on feature can be obtained with the application of Velcro material.

The preferred embodiment provides a hemispherical coverage pattern when the radiating structure is located on helmet or on a backpack surface.

The preferred embodiment structure can function under multiple frequencies on UHF and S frequency bands.

The preferred embodiment having the radiating element on the top of a helmet in such a way it will receive less interference from its surroundings.

The preferred embodiment structure is passive and external power is not required.

The preferred embodiment structure does not require frequency turning or adjustment.

The preferred embodiment structure can be configured to operate over a frequency band of 800 MHz to 5000 MHz.

The preferred embodiment of backpack or helmet design can be shared by two Wi-Fi systems of good frequency separation. This is accomplished by employing a circulator and a filter to route signals to its respective terminal. A wide frequency separation allows the filter to be configured in a simple way in a form of a high or low pass filter.

Another preferred embodiment of claim 1 consisting: a vertical and a horizontal radiating element (FIG. 3) along with a hybrid device that are connecting in such a way that both left and right circular polarizations are provided.

DETAIL DESCRIPTION

The subject invention antenna consists of a pair of unique shape triangular elements which are excited by a coaxial cable symmetrically to form the unique input balun (balanced-to-unbalanced converter). The balun is extremely broad band.

The radiating element is operating over a metallic surface. The function of the metal surface is to help reflect radiation energy away from the head or body of a person operating the apparatus and also functioning as a ground plane for the radiating structure to provide the desired hemispherical radiation pattern.

Antenna Radiating Element Design

The radiating element is the most critical part of this invention. Conventional antenna approach in backpack, the antennas are whip designs of various heights and these designs lack of broad band performance. As a result, multiple whip radiators are often employed in a system involving multiple frequencies.

The invention antenna describes here is composed two triangular surfaces that are positioned facing one another, see FIG. 1. The preferred vertex angles are 90° and the base angles are 45°. The tips are separated about ⅜ of an inch. The arm length is about 3 inches on the backpack stick-on design and the curve length of the triangular radiator arms on the helmet design are also approximately 3 inches.

FIG. 1 shows the radiating element excited symmetrically by a coaxial of RG58/U or similar. With the exterior jacket removed, the outer shield of the cable is electrically connected to the input side of the triangular radiator. The center conductor is electrically connected to the conjugated side through the apex. The coaxial cable can be soldered, spot welded, or mechanically fastened to the radiating element for good electrical connection. The coaxial cable is terminated with a connector mating to the electronic equipment.

The radiating structure is designed such that it can easily place over the helmet.

The Radiating element can also function by simply sticking onto the outer surface of the backpack.

Antenna Ground Plane

The main purpose of the antenna metal shield is to prevent harmful radiation to the head and body areas of a person and has also performed well for the radiator in obtaining good radiation coverage. The ground plane is configured to be placed over the hat or helmet and is made of flexible materials such as fine meshes of metal. It is protected by a waterproof cover. The stick on feature is obtained via Velcro material.

Antenna Coverage Pattern

The radiation coverage pattern of the disclosure antenna on a helmet is hemispherical and the polarization is predominantly vertical. A horizontal component is present when the operating frequencies are nearing the high end of the frequency band. The polarization of the backpack stick on antenna is linear vertical and the coverage pattern is also hemispherical.

DRAWINGS

FIG. 1—Backpack Antenna

FIG. 1 presents a plane view of the stick-on antenna design. The vertex angle 1 is 90° and the base angles 2 are 45°. The height of the antenna element 3 including the gap is 6⅜ inches. The antenna element width 4 is 6⅜ inches. The coaxial cable 5 is soldered to the triangle shape radiating elements 6. The coaxial cable is terminated with a connector 7, mating to the connector of the electronic equipment. The location 8 is the ⅜ inches gap. The enclosure of the stick-on radiator is 9. A small change of angles and dimensions will not alter the general performance of the antenna.

Figure 2:
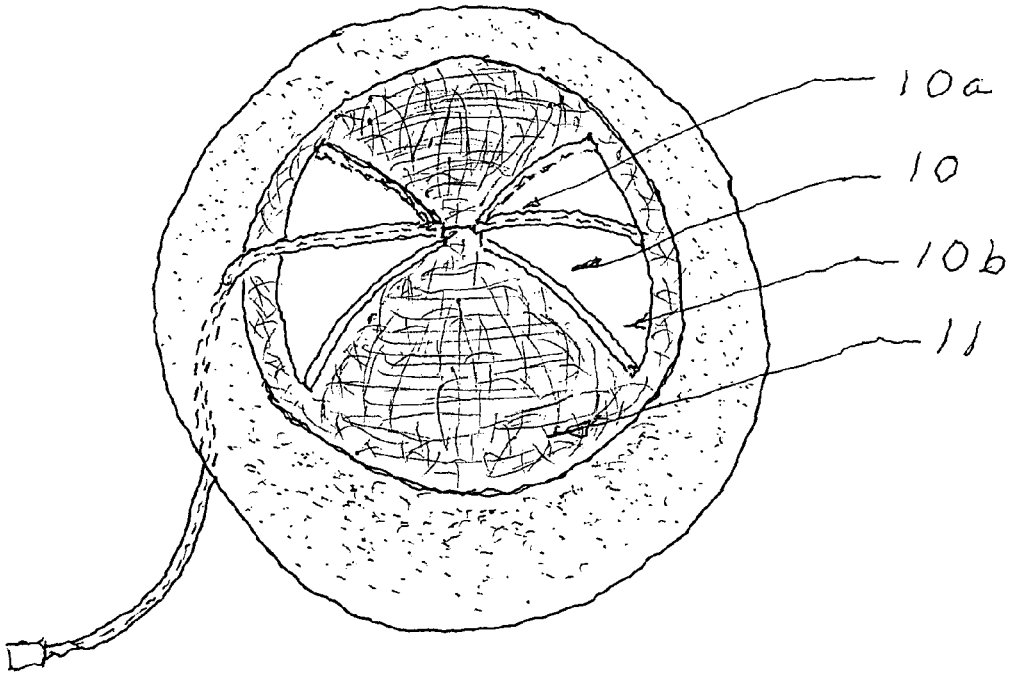

FIG. 2—Helmet Antenna

FIG. 2 presents a prospective view of a helmet antenna. The curve triangle shape radiating element 10 is located on the top of the helmet and radiating over the fine mesh metal ground plane 11 which covers the dome part of the helmet. The element design is identical to FIG. 1 and having a shape fits over a helmet. The vertex angle 10*a* and base angles 10*b* are 90 degrees and 45 degrees.

Figure 3:
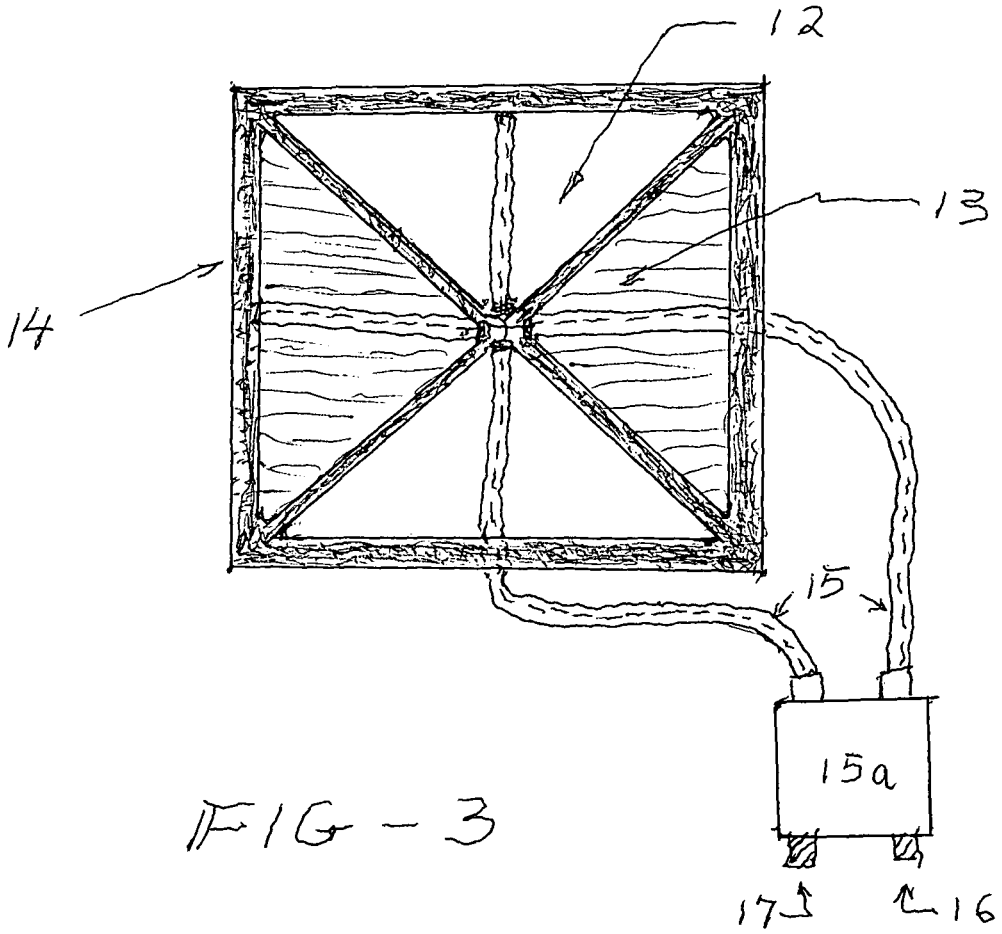

FIG. 3—Circular Polarization Backpack Antenna

FIG. 3 presents a plane view of a circular polarization stick-on antenna. Two sets of radiating elements 12 and 13 are positioned orthogonal to one another in the same square aperture 14 of 6⅜ inches sides. The radiating element dimensions are identical to FIG. 1 measurements. The coaxial cables 15, connecting the 90 degrees hybrid coupler device 15*a* to the radiating elements, are equal in length. The input ports 16 and 17 of the 90 degrees hybrid coupler are the left and right hand transmitting and receiving ports of the communication system and simultaneous transmission and receiving of left and right hand signals are provided.

The invention claimed is:

1. A stick-on antenna structure comprising:

a radiating element having a pair of polygonal radiators positioned such that one is opposing the other at their vertices, a coaxial cable runs along the center of the radiating element and along the two opposing vertices characterized in that;

the coaxial cable has a gap where the two vertices meet, separating its outer shield conductor into two parts, each part of the outer shield conductor is electrically and physically connected to both respective one side of the opposing vertices while the center conductor passes through the conjugated opposing vertices forming an infinite balun and, an electrical excitement is applied by the infinite balun to excite all the radiators, with the infinite balun providing an impedance bandwidth ratio greater than 30 to 1, the polygonal radiators are covered with a metal shielding surface and the shielding surface performs as a ground plane and acts as a protectant from radiation hazards to the head or body area, the ground plane as well as the associate radiating elements is designed for quick mounting, having a stick-on feature, the radiating elements are on a flat plane;

for affixing on a backpack or helmet.

* * * * *